US009062572B2

(12) United States Patent
Kameda et al.

(10) Patent No.: US 9,062,572 B2
(45) Date of Patent: Jun. 23, 2015

(54) VARIABLE CAM PHASER FOR AUTOMOBILE ENGINE AND CONTROLLER THEREFOR

(75) Inventors: Michihiro Kameda, Hadano (JP); Takumi Totsuka, Hadano (JP)

(73) Assignee: NITTAN VALVE CO., LTD., Hadano-shi (JP)

( * ) Notice: Subject to any disclaimer, the term of this patent is extended or adjusted under 35 U.S.C. 154(b) by 131 days.

(21) Appl. No.: 13/703,514

(22) PCT Filed: Jul. 2, 2010

(86) PCT No.: PCT/JP2010/061309

§ 371 (c)(1),
(2), (4) Date: Mar. 22, 2013

(87) PCT Pub. No.: WO2012/001812

PCT Pub. Date: Jan. 5, 2012

(65) Prior Publication Data

US 2013/0206089 A1 Aug. 15, 2013

(51) Int. Cl.

| | |
|---|---|
| ***F01L 1/34*** | (2006.01) |
| ***F01L 1/344*** | (2006.01) |
| *F01L 1/352* | (2006.01) |

(52) U.S. Cl.

CPC ..... *F01L 1/344* (2013.01); *F01L 1/34409* (2013.01); *F01L 2800/00* (2013.01); (Continued)

(58) Field of Classification Search

CPC ... F01L 1/34409; F01L 1/344; F01L 2800/00; F01L 2001/34453; F01L 2820/044; F01L 2820/031; F01L 2820/041; F01L 2820/042; F01L 2001/3522

USPC ..... 132/90.15, 90.17; 123/90.15, 90.17

See application file for complete search history.

(56) References Cited

U.S. PATENT DOCUMENTS

| | | | |
|---|---|---|---|
| 2002/0100446 | A1 | 8/2002 | Watanabe |
| 2003/0070641 | A1 | 4/2003 | Watanabe et al. |

(Continued)

FOREIGN PATENT DOCUMENTS

| | | | |
|---|---|---|---|
| JP | 2002-227623 | A | 8/2002 |
| JP | 2003-120227 | A | 4/2003 |

(Continued)

OTHER PUBLICATIONS

International Search Report for PCT/JP2010/061309, mailing date of Sep. 28, 2010.

(Continued)

*Primary Examiner* — Zelalem Eshete

(74) *Attorney, Agent, or Firm* — Westerman, Hattori, Daniels & Adrian, LLP

(57) ABSTRACT

This invention provides an improved variable cam phaser for an automobile engine equipped with a controller capable of enabling execution of a given phase angle varying command in a shortened response time. The variable cam phaser has two control rotors which are arranged coaxial with a camshaft and rotatable relative to each other under the influence of two electromagnetic actuators and driven by the crankshaft of the engine. The variable cam phaser also has a relative phase angle varying mechanism for varying the relative phase angle of the camshaft relative to the crankshaft. When the two electromagnetic actuators are simultaneously energized, the two control rotors are held mutually unrotatable. However, when the braking torque of one actuator is reduced, the control rotor associated with that actuator is rotated relative to the other control rotor to immediately start the execution of the command.

2 Claims, 11 Drawing Sheets

(52) U.S. Cl.
CPC ..... *F01L 2001/34453* (2013.01); *F01L 2001/3522* (2013.01); *F01L 2820/031* (2013.01); *F01L 2820/041* (2013.01); *F01L 2820/042* (2013.01); *F01L 2820/044* (2013.01)

(56) References Cited

U.S. PATENT DOCUMENTS

| | | | | |
|---|---|---|---|---|
| 2010/0180844 | A1 | 7/2010 | Uehama et al. | |
| 2011/0036319 | A1 * | 2/2011 | Kameda et al. ..... | 123/90.17 |

FOREIGN PATENT DOCUMENTS

| | | | | |
|---|---|---|---|---|
| JP | 2005-146993 | A | | 6/2005 |
| JP | 2005146993 | A | * | 6/2005 |
| JP | 4027672 | B2 | | 12/2007 |
| JP | 2009-013975 | A | | 1/2009 |

OTHER PUBLICATIONS

Office Action dated Feb. 17, 2014, issued in corresponding Japanese Patent Application No. 2012-522410 (3 pages).

Office Action dated Aug. 26, 2014, issued in corresponding Chinese Patent Application No. 201080066409.3 (5 pages).

* cited by examiner

SECTION A-A

SECTION E -E

VARIABLE CAM PHASER FOR AUTOMOBILE ENGINE AND CONTROLLER THEREFOR

TECHNICAL FIELD OF THE INVENTION

This invention relates to a variable cam phaser and a controller therefor for an automobile engine for varying the relative phase angle between the crankshaft of the engine and the camshaft of the apparatus to vary the open/close valve timing.

KNOWN ART OF THE INVENTION

A known variable cam phaser for varying the relative phase angle between the crankshaft and camshaft to vary the open/close valve timing of an engine is disclosed in Patent Document 1 listed below. The variable cam phaser of Document 1 includes a drive plate driven by the crankshaft and a camshaft which is coaxial with, and rotatable relative to, the drive plate, and a guide plate, also coaxial with the crankshaft and subjected to a driving torque of the crankshaft via a first and a second electromagnetic brake, for actuating three link arms when the guide plate is rotated relative to the drive plate so as to vary the relative phase angle between the drive plate (crankshaft) and the camshaft.

Specifically, when the first electromagnetic brake is energized, the control plate integral with the guide plate is attracted so that the guide plate is rotated relative to the drive plate in the direction in which the phase angle of the guide plate is retarded (the direction hereinafter referred to as phase retarding direction) relative to the camshaft (in the direction opposite to the rotational direction of the drive plate). As a consequence, the camshaft is rotated relative to the drive plate (crankshaft) in the phase advancing direction (which is the same rotational direction as that of the drive plate) as disclosed in Patent Document 1. In the apparatus disclosed in Patent Document 1, when the inactivated second electromagnetic brake is energized, an associated braking plate is attracted by the electromagnetic brake and rotated in the phase advancing direction relative to the camshaft, so that the camshaft is rotated in the phase retarding direction relative to the drive plate (crankshaft). As a result, the relative phase angle between the crankshaft and camshaft, and hence the valve timing, is varied.

PRIOR ART DOCUMENT

Patent Document

PATENT DOCUMENT 1: JP 4027672

SUMMARY OF THE INVENTION

Object to be Achieved by the Invention

In the variable cam phaser disclosed in Patent Document 1, in order to keep the phase angle between the camshaft and the crankshaft unchanged (that is, to sustain the relative phase angle as it is) two electromagnetic brakes are held inoperable, and either the first or second electromagnetic brake is energized upon receipt of a phase varying command to vary the relative phase angle. As a consequence, it takes a certain period of time (referred to as response time) for an inactivated electromagnetic brakes to actually vary the relative phase angle between the crankshaft and camshaft. Since such long response time can cause an engine stall, it is preferably as short as possible.

The response time becomes longer especially when the camshaft is subjected to an external disturbing torque that arises from a reaction of a valve spring (not shown) or when a friction material of the electromagnetic brake is worn by aging. Thus, there is a need to shorten the reaction time of such variable cam phaser.

It is noted that although the two electromagnetic brakes of the prior art variable cam phaser use a control system to prevent the two brakes from exhibiting different response performances to a given phase varying command, the control system cannot shorten the response time between the issuance of the phase angle varying command and the subsequent initiation of the phase angle variation.

In view of such prior art problem as mentioned above, the present invention is directed to an improvement of a variable cam phaser and a control system therefore, in which the apparatus has a short response time to actually start varying the phase angle upon receipt of a phase angle varying command, thereby securing the controllability of the apparatus even when the crankshaft is subjected to an external disturbing torque or when the electromagnetic brakes are worn by aging.

Means for Achieving the Object

In accordance with claim 1, there is provided a variable cam phaser for an automobile engine for varying open/close valve timing of the engine, the apparatus having: two control rotors rotatable relative to each other, arranged coaxial with the camshaft of the variable cam phaser and driven by the crankshaft of the engine; two electromagnetic actuators (referred to as EMA in FIGS. 7-11) (corresponding to two electromagnetic brakes of Patent Document 1) adapted to provide the two control rotors with braking torques in the direction opposite to the rotational direction of the crankshaft; and a mechanism for varying the phase angle of the camshaft relative to the crankshaft, thereby varying the open/close valve timing of the engine, the apparatus characterized in that the two electromagnetic actuators initially operate simultaneously to render the two rotating control rotors mutually unrotatable, and that by reducing the braking torque of one electromagnetic actuator the control rotor associated with the braked actuator is accelerated to rotate relative to the other control rotor.

(Function) The two control rotors in rotation are initially kept unrotatable relative to each other under constant braking torques (or attractive forces) provided by the two electromagnetic actuators. But when the electric power supplied to one of the two electromagnetic actuators is reduced or cut off, the relative phase angle between the crankshaft and camshaft is promptly varied by a quick rotation of one control rotor relative to the other.

At the stage where a phase varying command is received, the two control rotors are unrotatably attracted to the friction materials by predetermined forces of the two electromagnetic actuators so as to permit one control rotor promptly start relative rotation at the moment when the force of said one electromagnetic actuator is weakened by the phase varying command. In other words, unlike conventional apparatuses, the inventive variable cam phaser of claim 1 requires no startup time to re-activate an inactivated electromagnetic actuator and put a brake on a control rotor.

As a result, the response time between the issuance of a phase varying command and the initiation of a phase angle variation is shorter in the inventive phase change apparatus than in the prior art.

The response time becomes longer when an external disturbing torque is applied to the crankshaft or when the electromagnetic actuators are aged. Since the variable cam phaser of claim 1 has two control rotors already attracted by the actuators with predetermined forces, the apparatus requires no startup time to attract one of the control rotors nor gets influenced by the aging of the electromagnetic brakes.

The variable cam phaser of claim 1 may be configured such that one of the two electromagnetic actuators that has a lowered braking torque recovers its initial braking torque to stop the relative rotation of the two control rotors, as recited in claim 2.

(Function) As the electromagnetic actuator that has lowered its braking torque restores its initial braking torque, the control rotor is again subjected to the braking torque of the actuator, so that the rate of varying the relative phase angle is decreased until the control rotor is stopped accurately at a target angular position. In this way, in the variable cam phaser of claim 2, a variation of relative phase angle between the crankshaft and camshaft is promptly and accurately completed, that is, the time required to complete the variation subsequent to the receipt of a phase change command is shortened.

An inventive variable cam phaser recited in claim 3 varies the relative phase angle between the camshaft and the crankshaft to vary the open/close valve timing of the engine in accord with the movement of the two control rotors by means of the torque of the crankshaft and the opposing torques of the two electromagnetic actuators. This can be done by the apparatus having: a cam angle sensor for detecting the current angle of the camshaft; a crankshaft angle sensor for detecting the current angle of the crankshaft; a deviation calculator for calculating the deviation or difference between (a) the current relative phase angle of the camshaft relative to the crankshaft calculated from the phase angles detected by the cam angle sensor and crankshaft angle sensor, and (b) the target relative phase angle of the camshaft relative to the crankshaft instructed by the phase varying command; means for determining the positivity/negativity (or plus/minus sign) of the deviation; a threshold discriminator adapted to determine whether or not the deviation is within a predetermined threshold range; an operation command section for commanding the two electromagnetic actuators to hold the two control rotors unrotatable relative to each other when the deviation is within the threshold range, but otherwise commanding one of the two electromagnetic actuators selected in accord with the sign of the deviation to decrease its torque; and a driver circuit for actuating one or two of the electromagnetic actuators according to the operation command given.

(Function) In the controller of claim 3, the current relative phase angle of the camshaft relative to the crankshaft is calculated from the phase angles of the camshaft and crankshaft detected by the cam angle sensor and crank angle sensor, and the target relative phase angle of the crankshaft relative to the crankshaft is obtained from the instruction received, from which a deviation or difference between these two relative phase angles is calculated to control the variable cam phaser.

In the case where the deviation is within the threshold range, two of the electromagnetic actuators are simultaneously activated to provide the two control rotors with constant braking toques (or attractive forces), thereby locking the two control rotors unrotatable relative to each other. On the other hand, when the deviation is outside the threshold range, one of the electromagnetic actuators is controlled such that its braking torque is reduced in accord with the sign of the deviation. Further, when the deviation is brought into the threshold range, the actuator which was forced to reduce its torque is allowed to restore its normal torque, thereby rendering the two control rotors mutually unrotatable.

It is noted that in the controller of claim 3 the two control rotors have been already subjected to constant braking torques of the electromagnetic actuators when a phase varying command is issued. Thus, it can be said that the two rotors are in standby condition ready to start a relative rotation upon receipt of a phase varying command without a response time required for conventional control rotors to start a relative motion following such command. As a consequence, the response time between the issuance of a phase varying command and the initiation of the phase change procedure is shorter for the inventive controller than for conventional controllers.

On the other hand, as the deviation is reduced to within the threshold range, the braking torque weakly applied on the control rotor is again increased, so that the phase varying procedure is promptly and accurately ended with the controller of claim 3. In this way, the controller of claim 3 reduces the entire response time between the issuance of a phase varying command and the completion of the phase varying operation.

Results of the Invention

According to the variable cam phaser of claim 1, the response performance of the variable cam phaser is enhanced by a shortened response time between the issuance of a phase varying command and its command execution timing. Further, the variable cam phaser of claim 1 has a fail-safe function to recover a normal relative phase angle between the crankshaft and camshaft lost by loss of control of the phase angle due to, for example, deterioration of engine oil, an extremely low or high ambient temperature, or engine stall.

As recited in claim 2, the variable cam phaser can increase the rate of varying the relative phase angle between the crankshaft and camshaft, whereby the time from the issuance to the completion of the phase varying command can be shortened.

The variable cam phaser of claim 3 can not only shorten the response time between the issuance of a phase varying command to the beginning of the phase varying operation, but also increase the rate of varying the relative phase angle. The apparatus can further shorten the total response time from the issuance to the completion of the command by correctly transmitting braking torques from the electromagnetic actuators to the control rotors.

It is noted that the variable cam phaser of claims 1 and 2, and the controller of claim 3 have improved response performance also in cases where an unexpected external disturbing torque is applied to the camshaft and the electromagnetic actuators are deteriorated by aging.

BRIEF DESCRIPTION OF THE DRAWINGS

FIG. 11(*b*) electromagnetic currents supplied to electromagnetic actuators embodying the present invention; FIG. 11(*c*) phase angle variation performed by a conventional controller; FIG. 11*d* electromagnetic currents supplied to the electromagnetic actuators operated under conventional conditions.

BEST MODE FOR CARRYING OUT THE INVENTION

The invention will now be described in detail by way of example with reference to a first embodiment of the invention as shown in FIGS. 1 through 6. The variable cam phaser of the first embodiment for an automobile engine is mounded on the engine. In the apparatus the rotational motion of the crankshaft is transmitted to the camshaft of the apparatus so as to open/close at least one air suction/exhaustion valve of the engine in synchronism with the crankshaft, and vary the open/close valve timing in accord with such operating parameters as load and rpm of the engine.

Figure 1:
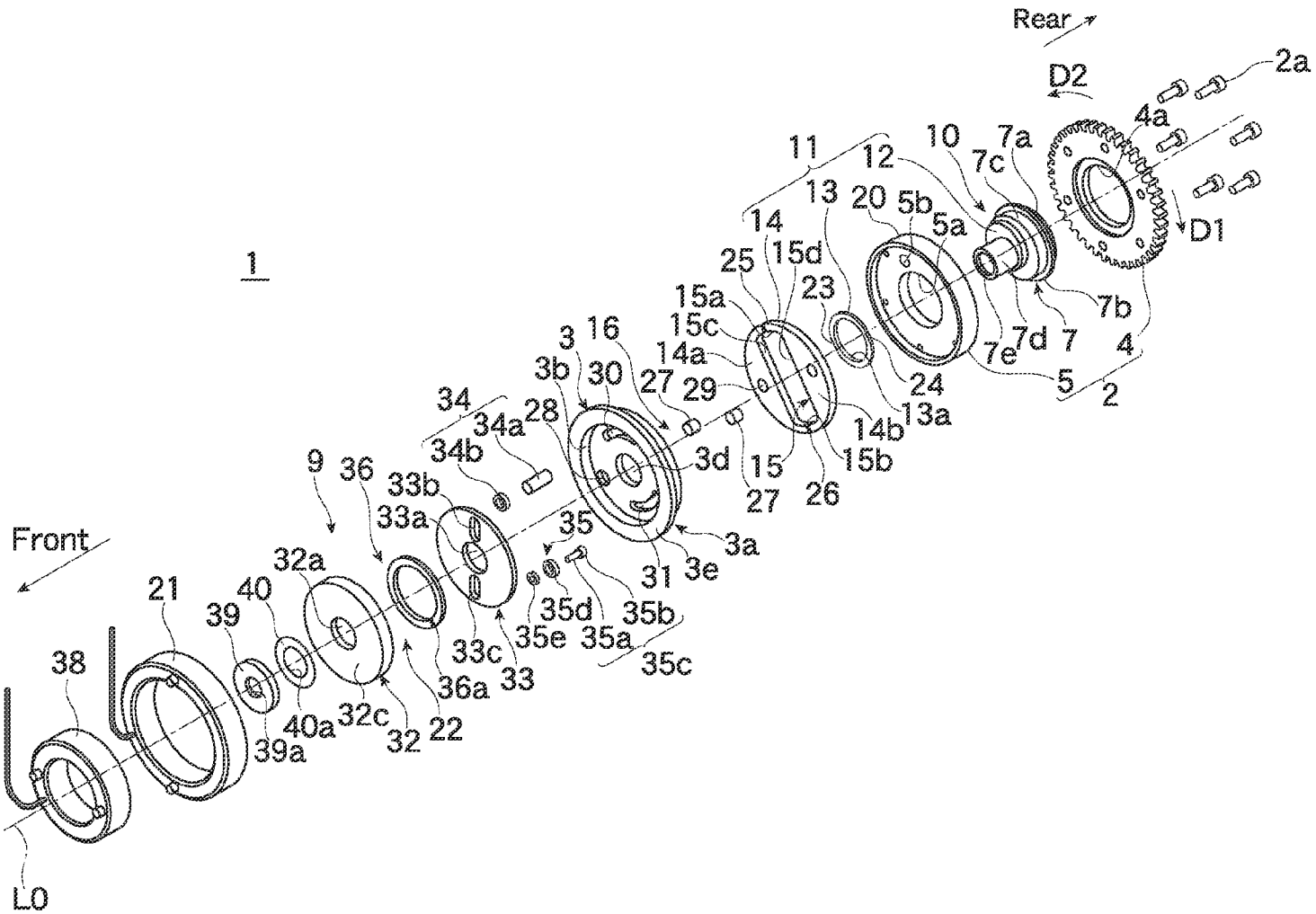
FIG. 1 is an exploded schematic view of a variable cam phaser for an automobile engine, as viewed from the front end of the apparatus.
Figure 2:
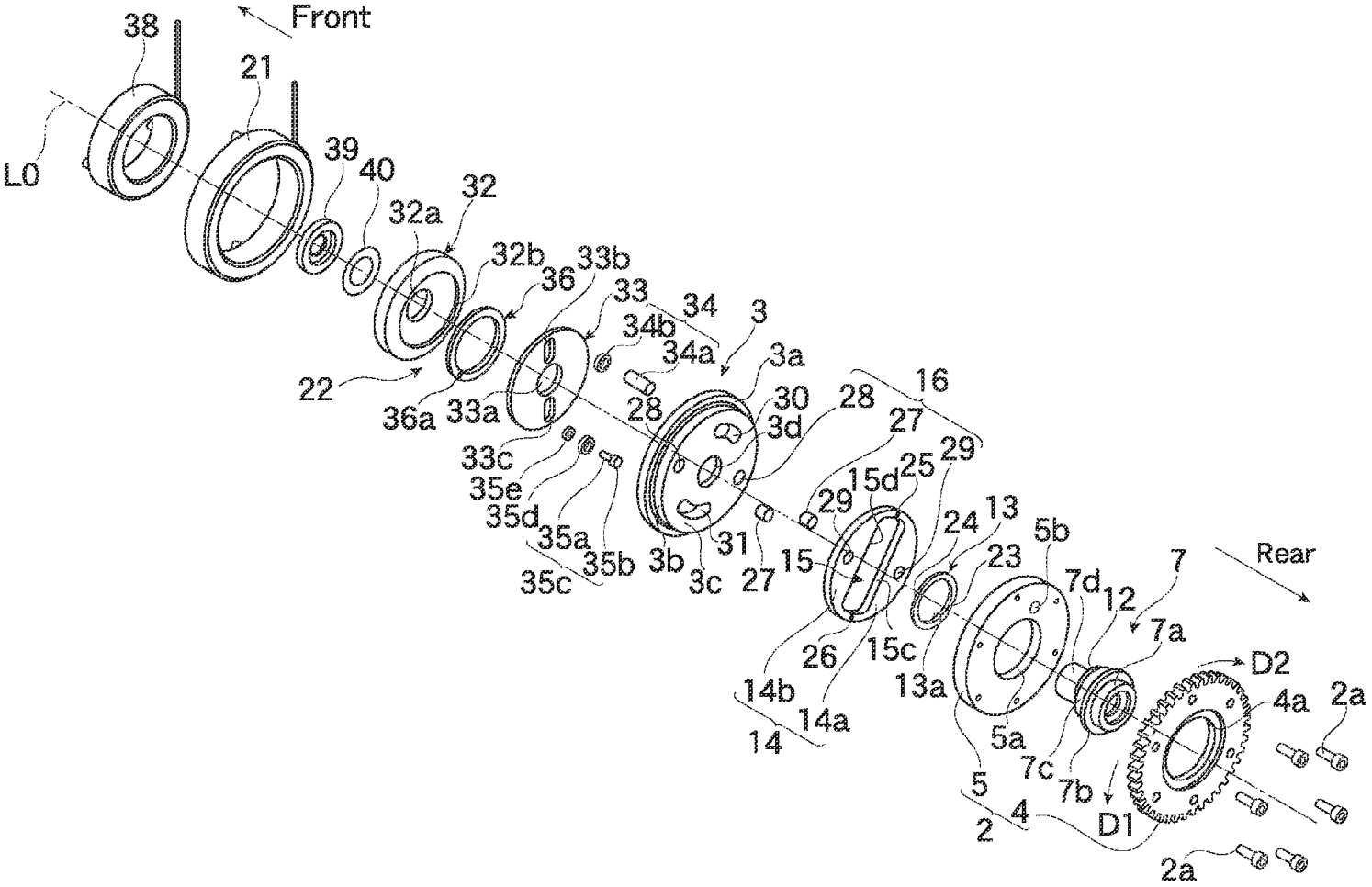
FIG. 2 is an exploded schematic view of the variable cam phaser as viewed from the rear end.
Figure 3:
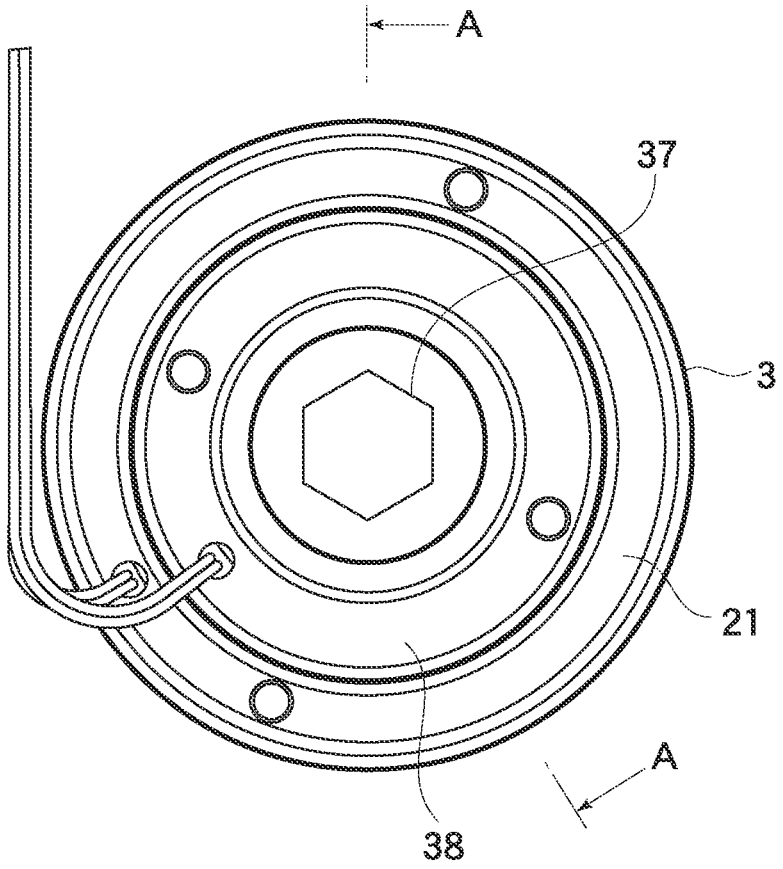
FIG. 3 is a front view of the apparatus in accordance with a first embodiment of the invention (excluding cover 70).

The variable cam phaser 1 of the first embodiment has a drive rotor 2 driven by the crankshaft; a first control rotor 3 (which is the control rotor defined in claim 1); a camshaft 6 (shown in FIG. 4); torque means 9; a phase angle varying mechanism 10; and a self-locking mechanism 11. In what follows one end of the apparatus having a second electromagnetic actuator will be referred to as the front end and the other end having the drive rotor 2 will be referred to as the rear end (FIG. 1). The clockwise direction of the drive rotor 2 about the camshaft axis L0 as seen from the front end will be referred to as the phase advancing direction D1, while the opposite counterclockwise direction referred to as phase retarding direction D2.

Figure 4:
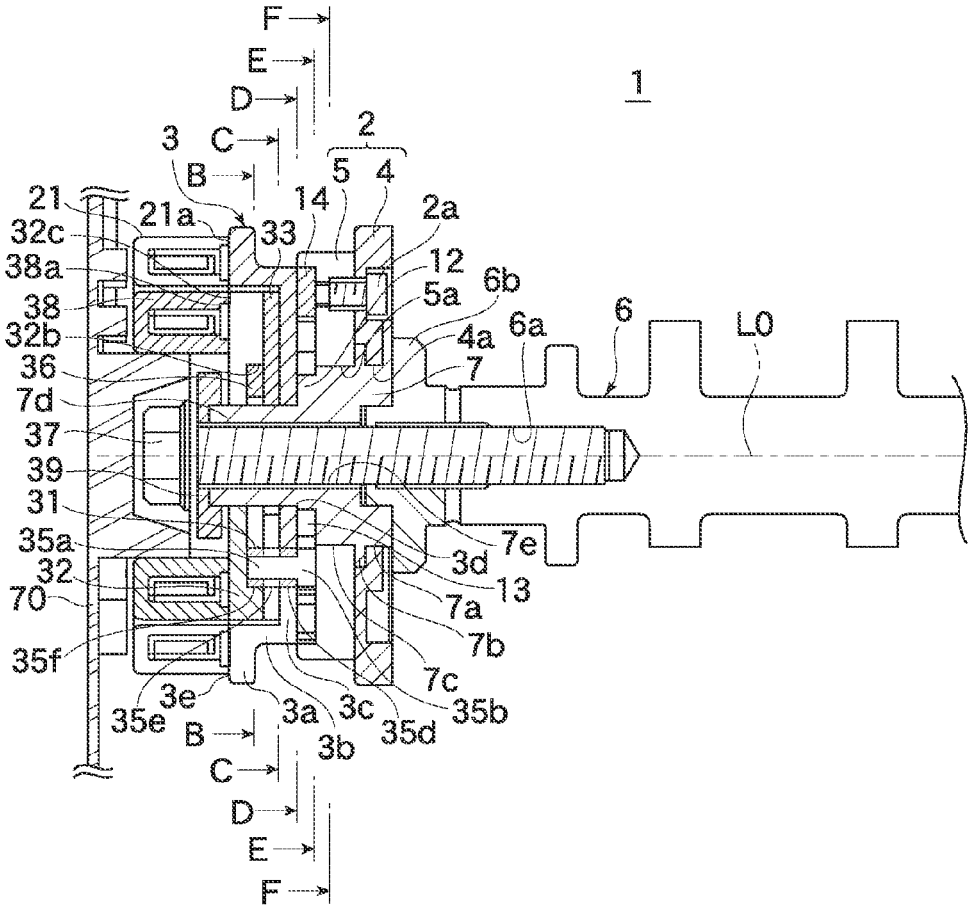
FIG. 4 is a cross section taken along line A-A of FIG. 3.

The drive rotor 2 consists of a drive cylinder 5 having a sprocket 4 driven by the crankshaft and a cylinder section 20, all integrally fixed with a multiplicity of bolts 2*a*. The camshaft 6 shown in FIG. 4 is coaxially and unrotatably mounted on the rear end of the center shaft 7 by means of a bolt 37 inserted in the central circular hole 7*e* of the center shaft 7 and screwed into the threaded female hole 6*a* formed in the front end of the camshaft.

The first control rotor 3 is a contiguous bottomed cylinder in shape, comprising a flange section 3*a*, a cylindrical section 3*b* extending therefrom rearward, and a bottom 3*c*. Formed in the bottom 3*c* are a central circular hole 3*d*, a pair of pin holes 28, and an arcuate groove 30 having a predetermined radius from the axis L0 (the groove hereinafter referred to as arcuate groove 30), and an oblique guide groove 31 whose radius from the axis L0 gradually decreases in the phase advancing direction D1 (hereinafter the groove referred to oblique guide groove 31)

The center shaft 7 comprises a first cylindrical section 7*a*, flange section 7*b*, second cylindrical section 7*c*, circular eccentric cam 12 having a cam center L1 offset from the camshaft axis L0, and a third cylindrical section 7*d*, all arranged in sequence and in the order mentioned from the rear end towards the front end. The drive rotor 2 is rotatably supported directly by the center shaft 7 passing through the circular holes 4*a* and 5*a* of the sprocket 4 and drive cylinder 5, respectively, with the flange section 7*b* sandwiched between the sprocket 4 and drive cylinder 5, and hence supported indirectly by the camshaft 6. The third cylindrical section 7*d* is inserted in the central circular hole 3*d* of the first control rotor 3. It is noted that the drive rotor 2, first control rotor 3, camshaft 6, and center shaft 7 are coaxial with the camshaft axis L0.

The torque means 9 consists of a first electromagnetic actuator 21 for acting a first braking torque on the first control rotor 3 so as to allow the first control rotor 3 to rotate relative to the drive rotor 2; and a reverse rotation mechanism 22 having a second electromagnetic actuator 38 for providing the first control rotor 3 with a second torque in the opposite direction with respect to the first torque provided by the first electromagnetic actuator 21, by putting a brake on the second control rotor 32 by means of the second electromagnetic actuator 38.

The relative phase angle varying mechanism 10 consists of the center shaft 7 for rotatably supporting the drive rotor 2, self-locking mechanism 11 and coupling mechanism 16 to integrally lock the camshaft 6 and first control rotor 3.

The self-locking mechanism 11, arranged between the drive rotor 2 and center shaft 7, consists of the eccentric circular cam 12 of the center shaft 7, lock plate bush 13, lock plate 14, and cylinder section 20 of the drive rotor 2 to prevent an unexpected deviation in relative phase angle between the drive rotor 2 and camshaft 6 due to an external disturbing torque transmitted a valve (not shown) to the camshaft 6.

Figure 5:
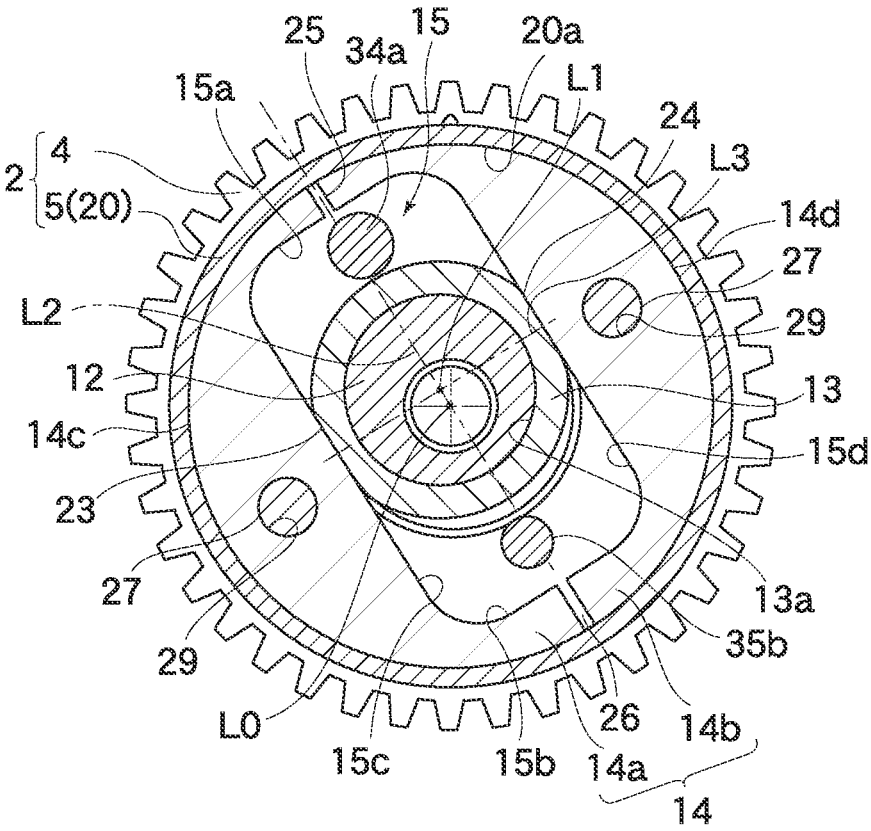
FIG. 5 is a cross section taken along line E-E of FIG. 4.

The lock plate bush 13 has a central circular hole 13*a* in which the eccentric circular cam 12 of the center shaft 7 is engaged as shown in FIGS. 1 and 5. The lock plate bush 13 also has a pair of flat faces 23 and 24 on the opposite sides of its periphery, and is rotatably mounted on the eccentric circular cam 12 such that the flat faces 23 and 24 are aligned in parallel to the line L2 passing through the camshaft axis L0 and the cam center L1.

The lock plate 14 has a generally disk shape configuration, and is formed with a generally rectangular plate holder groove 15 extending in a diametrical direction for holding therein the lock plate bush 13. The lock plate 14 consists of a pair of constituent members 14*a* and 14*b* separated by a pair of slits 25 and 26 that extends linearly from the short ends 15*a* and 15*b* of the plate holder groove 15 towards the periphery of the lock plate 14. The flat faces 23 and 24 of the lock plate bush 13 are held in contact with the long sides 15*c* and 15*d*, respectively, of the plate holder groove 15.

The lock plate 14 is inscribed in the cylinder section 20 of the drive cylinder 5, so that the outer peripheries 14*c* and 14*d* of the lock plate 14 are in contact with the inner periphery of the cylinder section 20. Under this condition, the portion of the outer periphery of the eccentric circular cam 12, which is further offset from the camshaft axis L0 beyond line L3 that intersects line L2 perpendicularly at the cam center L1, is supported by the plate holder groove 15 of the lock plate 14 via the lock plate bush 13.

A coupling mechanism 16 has a pair of coupling pins 27, a pair of first pin holes 28 formed in the bottom 3*b* of the first control rotor 3, and a pair of second pin holes 29 formed in the lock plate constituent members 14*a* and 14*b*. Each of the coupling pins 27 is fixedly secured in either one of the first pin holes 28 or of the second pin holes 29, but loosely fitted in the second pin holes 29 or first pin holes 28.

The lock plate 14, inscribed in the cylinder section 20 of the drive cylinder 5 and holding the lock plate bush 13, is unrotatably fixed to the first control rotor 3 by inserting the coupling pins 27 in the first pin holes 28. As a consequence, the center shaft 7 (and hence the camshaft 6) is unrotatably fixed (integrated) to the first control rotor 3 via the eccentric circular cam 12, lock plate bush 13, and lock plate 14.

Next, the torque means 9 will be described in detail. The first electromagnetic actuator 21 is mounted inside the engine, in front of the first control rotor 3 so that the front end 3*e* of the flange section 3*a* can be attracted onto the friction material 21*a* of the first electromagnetic actuator 21.

A reverse rotation mechanism 22 consists of the arcuate groove 30 formed in the first control rotor 3, oblique guide groove 31, second control rotor 32, disk-shaped pin guide plate 33, second electromagnetic actuator 38 for putting a brake on the second control rotor 32, first and second link pins 34 and 35, respectively, and ring member 36.

The second control rotor 32 is arranged inside the cylindrical section 3*b* of the first control rotor 3 and is rotatably mounted on the third cylindrical section 7*d* of the center shaft 7 passing through the central circular throughhole 32*a* formed in the second control rotor. The second control rotor 32 is provided on the rear end thereof with a stepped eccentric circular hole 32*b* having a center 01 offset from the camshaft axis L0. The ring member 36 is rotatably inscribed in the eccentric circular hole 32*b*. The second electromagnetic actuator 38 is mounted in front of the second control rotor 32 internally (that is, inside the engine) so that the front end 32*c* of the second control rotor 32 can be attracted onto the friction material 38*a* of the second electromagnetic actuator 21.

The disk shaped pin guide plate 33 is arranged inside the cylindrical section 3*b* of the first control rotor 3, between the bottom 3*c* of the first control rotor 3 and the second control rotor 32, and is rotatably supported by the third cylindrical section 7*d*. The pin guide plate 33 has elongate radial grooves 33*b* and 33*c*. The radial groove 33*b* is formed, in association with the arcuate groove 30, to extend from a position near the central circular throughhole 33*a* to the outer periphery of the pin guide plate 33 (FIG. 6(*b*)), while the elongate radial guide groove 33*c* is formed, in association with the oblique guide groove 31, to extend from a position near the central circular throughhole 33*a* to a point near the outer periphery.

A first link pin consists of a thin round shaft 34*a* and a thick hollow round shaft 34*b* integrated at the front end thereof with the thin round shaft 34*a*. The first thick hollow round shaft 34*b* is supported on the opposite end thereof by the radial groove 33*b*, while the rear end of the thin round shaft 34*a* is passed through both the arcuate groove 30 and plate holder groove 15, and fixedly fitted in a mounting hole 5*b* formed in the drive cylinder 5. The thin round shaft 34*a* moves along, and between the opposite ends of, the groove 30.

A second link pin 35 consists of a first member 35*c*, first hollow shaft 35*d*, second hollow shaft 35*e*, and third hollow shaft 35*f*, where the first member 35*c* is made up of a thick round shaft 35*b* integrated with the rear end of a thin round shaft 35*a*. These first through third hollow shafts (35*d*-35*f*) are coaxially mounted in sequence with one thicker shaft on another shaft, and securely fixed at one end thereof, to the thin round shaft 35*a*. The thick round shaft 35*b* is inserted in the plate holder groove 15. The first hollow shaft 35*d* has a generally flattened round cross section with its upper and lower ends curving along, and supported by, the upper and lower arcuate walls of the oblique guide groove 31 so that it is slidable in the oblique guide groove 31. The second hollow shaft 35*e* has a cylindrical shape, and is supported on the opposite sides thereof by the radial guide groove 33*c* so that it is movable in the radial guide groove 33*c*. The third hollow shaft 35*f* has a cylindrical shape and is rotatably coupled to the circular hole 36*a* formed in the ring member 36.

Fitted from front onto the leading end of the third cylindrical section 7*d* of the center shaft 7 are a holder 39 and a washer 40 having a central circular hole 39*a* and 40*a*, respectively, so that the holder 39, washer 40, and center shaft 7 are unrotatably fixed to the camshaft 6 with the bolt 37 screwed into a threaded female hole 6*a* of the camshaft 6. As a consequence, all the members arranged between the drive rotor 2 and the second control rotor 32 inclusive along the center shaft 7 are securely fixed between the flange section 6*b* of the camshaft 6 and the holder 39. By adjusting the thickness of the washer 40, the axial clearances between the respective members can be optimized. A cover 70 is arranged in front of the first and second actuators 21 and 38.

The operation of the torque means 9 for varying the relative phase angle between the camshaft 6 and the drive rotor 2 (and crankshaft not shown) will now be described in detail. Under a normal operating condition, the first control rotor 3 is rotated by the torque of the crankshaft in D1 direction together with the second control rotor 32 (FIG. 6(*c*) under constant attractive forces (braking toques) of the first and second electromagnetic actuators 21 and 38, respectively. In this instance, the torques of the crankshaft acting on the first and second control rotors 3 and 32, respectively, are balanced with the braking torques of the first and second electromagnetic actuators 21 and 38, respectively, so that the two control rotors remain mutually unrotatable. However, if the braking torque of the first electromagnetic actuator 21 is reduced or cut off, the torque of the crankshaft acting on the first control rotor 3 becomes unbalanced with the braking torques of the first electromagnetic actuator 21 and second electromagnetic actuator 38, so that the first control rotor 3 begins to rotate in D1 direction relative to the second control rotor 32 and pin guide plate 33.

As a consequence, the center shaft 7 (camshaft 6) is rotated in D1 direction relative to the drive rotor 2 which is rotating in D1 direction together with the integrated first control rotor 3. Accordingly, the phase angle of the camshaft 6 relative to the drive rotor 2 (crankshaft not shown) is changed in the phase advancing direction D1, thereby changing the valve timing of the engine. If the braking torque of the first electromagnetic actuator 21 is increased back to its initial level, the relative rotation of the first control rotor is stopped relative to the second control rotor, and the phase angle of the camshaft 6 relative to the drive rotor 2 (crankshaft not shown) is maintained as it is.

Figure 6:
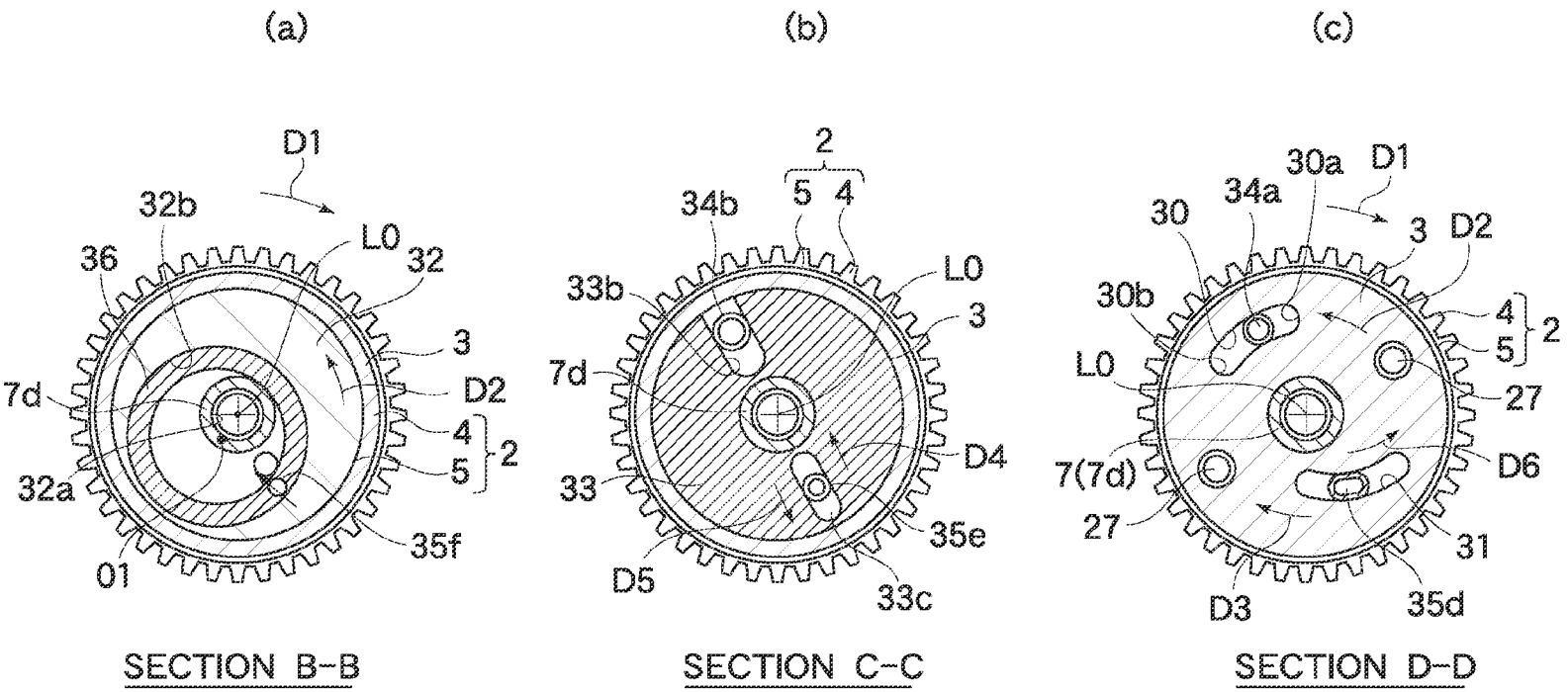
FIGS. 6(*a*), (*b*), and (*c*) are cross sections taken along line B-B, C-C; and D-D, respectively, of FIG. 4.

In this instance, the first hollow shaft 35*d* of the second link pin 35 shown in FIG. 6(*c*) moves within the curved guide groove 31 substantially the counterclockwise direction D6, while the second hollow shaft 35*e* shown in FIG. 6(*b*) moves in the radial guide groove 33*c* in D5 direction, that is, away from the camshaft axis L0. Thus, the third hollow shaft 35*f* of FIG. 6(*a*) causes the ring member 36 to be slidably rotated in the eccentric circular bore 32*b*. The thin round shaft 34*a* of the first link pin 34 moves in the arcuate groove 30 in the counterclockwise direction D2. The opposite ends 30*a* and 30*b* of the arcuate groove 30 act as stoppers for stopping the movement of the thin round shaft 34*a*.

When the first and second control rotors 3 and 32, respectively, are held unrotatable under the braking torques of the first and second electromagnetic actuators 21 and 38, respectively, the second control rotor 32 will be rotated by the torque of the crankshaft in D1 direction relative to the first control rotor 3 if the braking torque of the second electromagnetic actuator 38 is reduced or cut off. As the eccentric circular hole 32*b* is eccentrically rotated in D1 direction, the ring member 36 of FIG. 6(*a*) inscribed in the eccentric circular hole 32*b* is slidably rotated within the eccentric circular hole 32*b*. Because of this movement of the ring member 36, the second hollow shaft 35*e* of FIG. 6(*b*) is moved in the radial guide groove 33*c* towards the camshaft axis L0 together with the third hollow shaft 35*f* and first hollow shaft 35*d*. In this instance, the first control rotor 3 of FIG. 6(*c*) is subjected to a phase retarding torque exerted by the first hollow shaft 35*d* moving in the oblique guide groove 31 in the clockwise direction D3. This phase retarding torque acts on the control rotor 3 in the phase retarding direction D2 via the oblique guide groove 31, in just the opposite direction when moving under the action of the first electromagnetic actuator 21. Thus, the first control rotor 3 is rotated in the phase retarding direction D2 relative to the drive rotor 2. As a consequence, the phase angle of the camshaft 6 relative to the drive rotor 2 (crankshaft not shown) is changed in the phase retarding direction D2, thereby varying the open/close valve timing of the engine.

Figure 7:
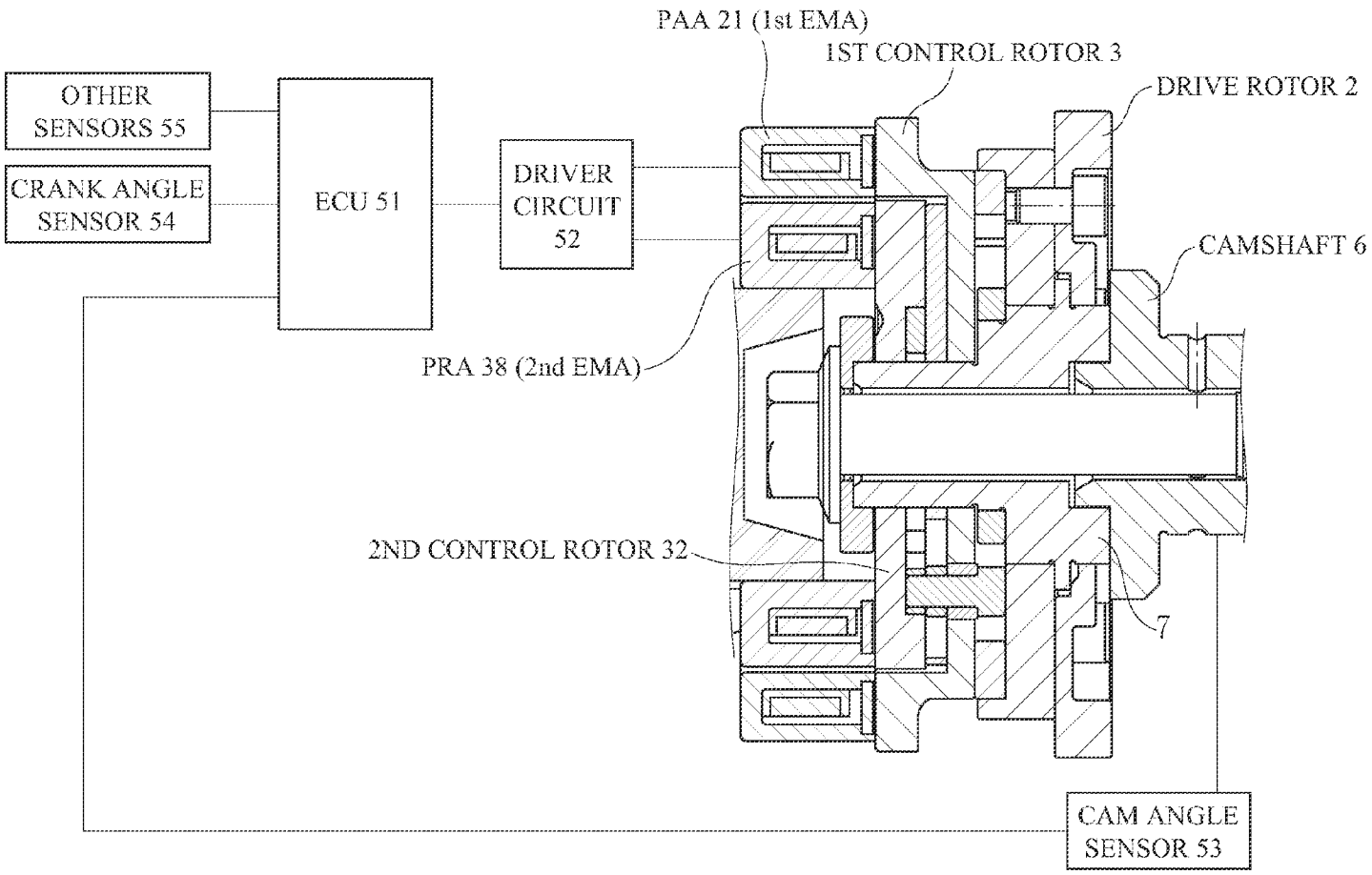
FIG. 7 is a diagram illustrating the structure of a controller for use with an inventive variable cam phaser.

Next, a controller 50 of the variable cam phaser in accordance with a first embodiment of the invention will be described. The controller 50 consists of an engine control unit (ECU) 51, driver circuit 52, cam angle sensor 53, crank angle sensor 54, and other sensors 55 as shown in FIG. 7.

The ECU 51 is connected to the driver circuit 52, which is in turn connected to the first electromagnetic actuator 21 and second electromagnetic actuator 38. Upon receipt of a command from the ECU 51, the driver circuit 52 drives the first and second electromagnetic actuators 21 and 38, respectively. On the other hand, the ECU 51 is connected to the cam angle sensor 53 (driver circuit 52), crank angle sensor 54, and other sensors 55 (described later) for detecting the rpm and lubricant temperatures of the control rotors.

Based on the information detected by and collected from various sensors (53-55), the ECU 51 instructs the driver circuit 52 to drive the first and second electromagnetic actuators 21 and 38, respectively, in a preferred mode with predetermined electric currents. The ECU 51 also has a deviation calculation section 58 for calculating the deviation of the current relative phase angle of the camshaft 6 relative to the crankshaft (not shown) from their target relative phase angles; a sign determination section 59 for determining the positivity/negativity (sign) of the deviation; a threshold determination section 60 for determining whether or not the deviation is within a predetermined threshold range; and an operation controller (such as CPU not shown) that includes an operation commanding section 61 providing the driver circuit 52 with an operation command to energize the first and/or second electromagnetic actuators with a preferred level of electric current in accord with the magnitude and sign of the deviation, and a command correction section 62 for correcting the level of the electric current as instructed by the operation command, based on the rpms and lubricant temperatures of the control rotors.

The driver circuit 52 actuates either one or both of the first and second electromagnetic actuator 21 and 38, respectively, based on a command signal issued by the ECU 51.

The cam angle sensor 53 and crank angle sensor 54 detect the current phase angles of the camshaft and crankshaft respectively, with reference to the respective predetermined angular positions and returns electric signals indicative of these phase angles. The electric signals are digitized by, for example, an A/D converter (not shown) provided in the ECU 51 in calculating the deviation of the current relative phase angle of the camshaft (relative to the crankshaft) from the target relative phase angle of the camshaft.

Other sensors 55 include, for example, a sensor 56 for detecting the rotational speed of the first and second electromagnetic actuators 21 and 38, respectively, and a oil temperature sensor 57 for detecting the temperatures of the lubricant that flows on the front ends of the electromagnetic clutches of the first and second control rotors. The electric signals indicative of data detected by the rotational speed sensor 56 and oil temperature sensor 57 are digitized in the ECU 51 and utilized to correct the braking torques of the first and second electromagnetic actuators 21 and 38, respectively, in accord with the rotational speed of the first and second control rotors 3 and 32, respectively, and the lubricant temperatures.

Next, referring to FIGS. 8 through 11, there is shown a specific method of controlling the first and second electromagnetic actuators 21 and 38, respectively, of the controller 50 in accordance with this embodiment of the invention.

Figure 10:
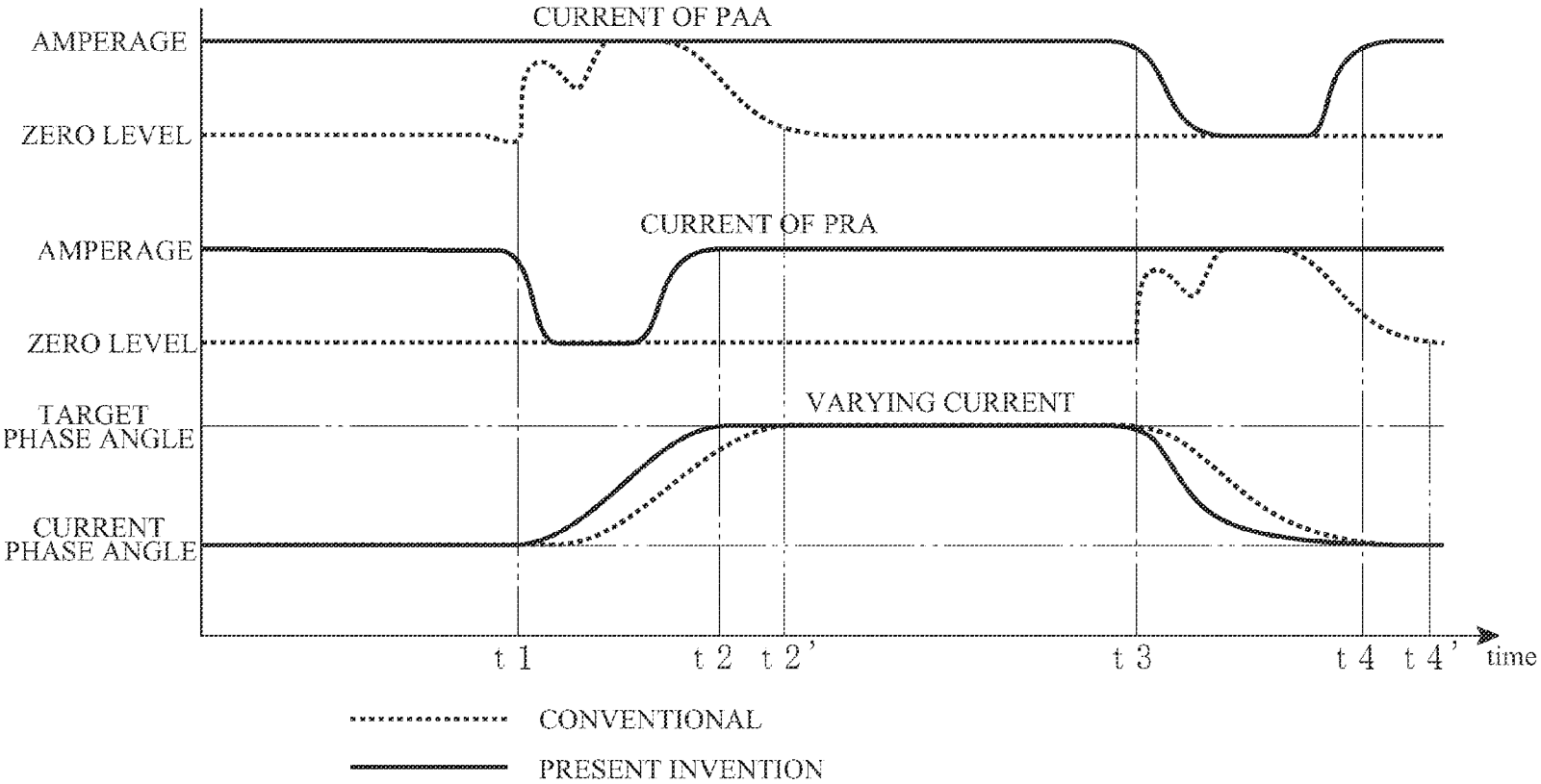
FIG. 10 is a diagram illustrating activation of the respective electromagnetic actuators during a phase varying operation.

Energization of the first and second electromagnetic actuators 21 and 38, respectively, for phase advancement and retardation is performed by energizing these actuators with electric currents indicated by solid curves as shown in FIG. 10 (curves referred to as "Electric Current to Phase Advancing Actuator" and "Electric Current to Phase Retarding Actuator"). Variations of the relative phase angle of the camshaft relative to the crankshaft from a given initial (or current) phase angle to a target phase angle and from the target value to the initial (or 'current') phase angle are as shown in FIG. 10 by solid curves (referred to as "Variation in Phase Angle").

Figure 8:
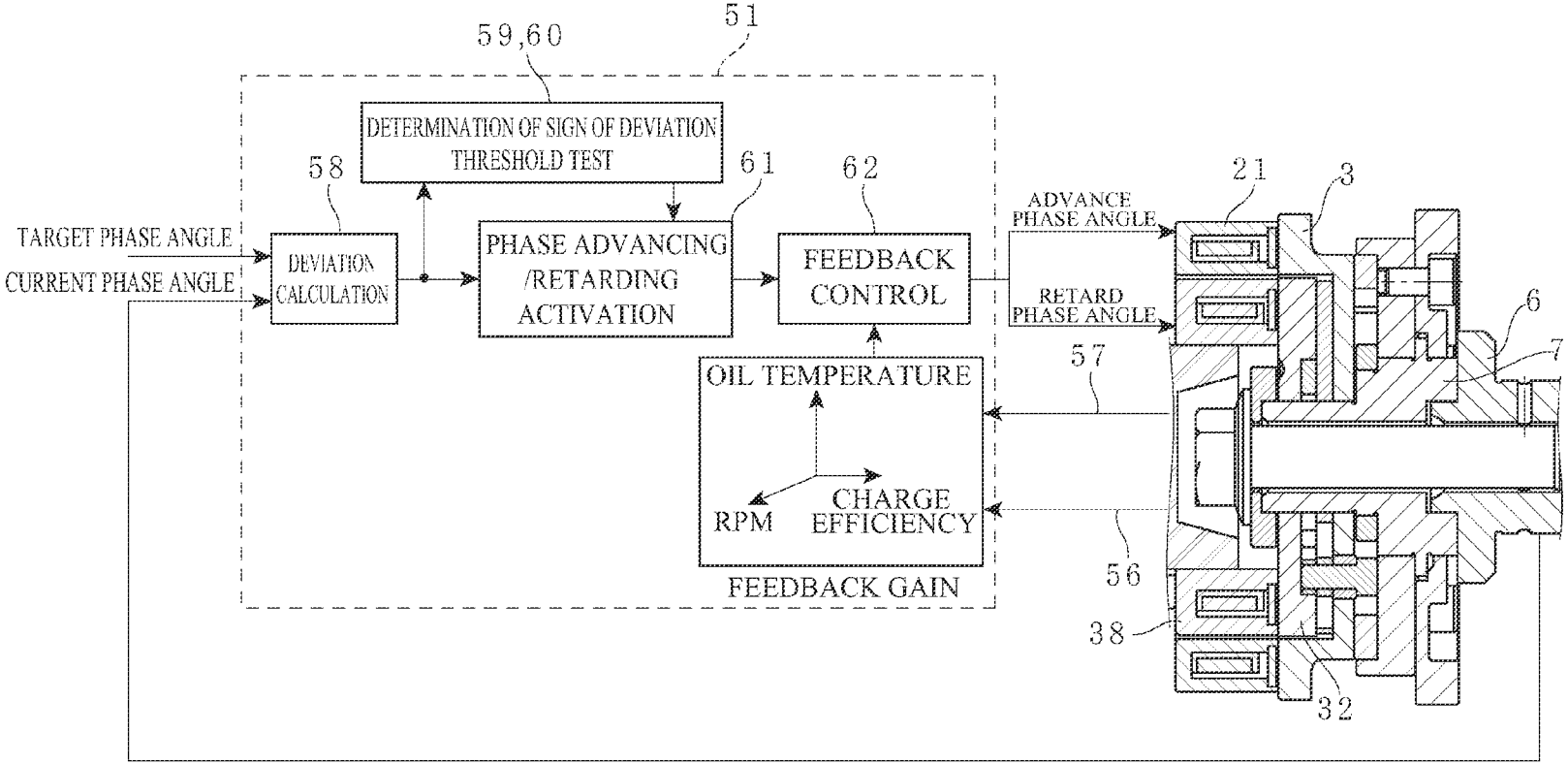
FIG. 8 is a block diagram of the controller of FIG. 7.

To begin with, suppose that the camshaft 6 has a given initial phase angle relative to the crankshaft (not shown), when the ECU 51 issues an operation command to the driver circuit 52 to simultaneously activate the first and second electromagnetic actuators 21 and 38, respectively, thereby rendering the two electromagnetic actuators unrotatable (Box 61 in FIG. 8). Incidentally, the level of the electric current supplied to the electromagnetic actuators for this purpose is pre-registered in, for example, a memory of the ECU 51.

It is noted that the magnitudes of the braking torques for holding the first and second control rotors mutually unrotatable depend not only on the rpms of the first and second control rotors 3 and 32, respectively, but also on the temperatures of the lubricant that flows on the front ends 32*c* of the control rotors, and that the registered values stored in the memory are appropriately updated frequently based on the data detected by the rpm sensor 56 and oil temperature sensor 57, respectively, as needed (See Box 62).

Upon receipt of the signal, the driver circuit 52 energizes both of the first and second electromagnetic actuators 21 and 38, respectively, as indicated by the solid curves shown in FIG. 10. While the first and second control rotors 3 and 32, respectively, are held mutually unrotatable by the predetermined braking torques exerted by the first and second electromagnetic actuators 21 and 38, respectively, the control rotors rotate together with the drive rotor 2 under the driving force of the crankshaft.

Figure 9:
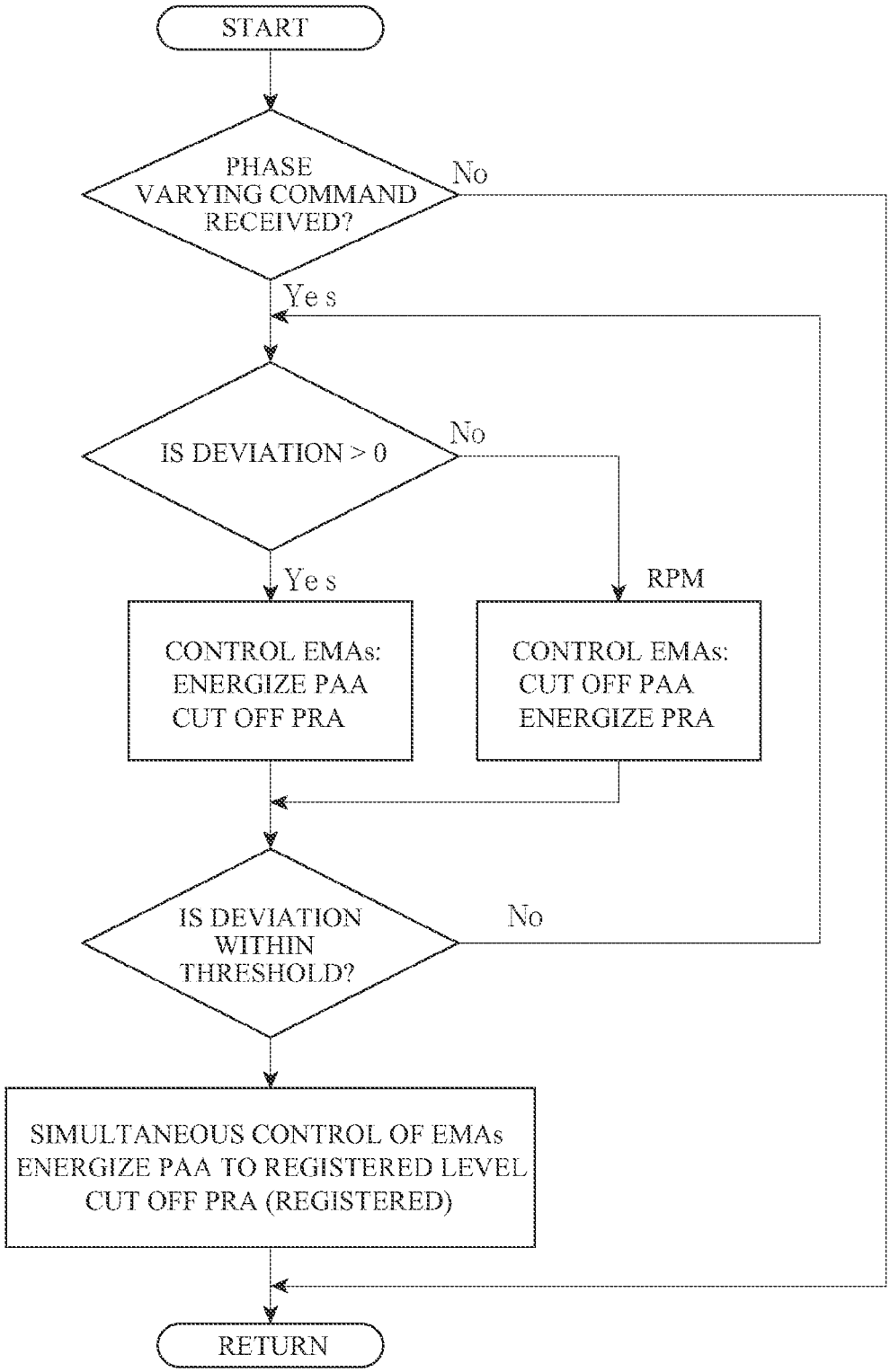
FIG. 9 is a flowchart illustrating the steps of the controller controlling the variable cam phaser.

Upon receipt of a command signal instructing the ECU 51 to vary the relative phase angle between the camshaft and crankshaft to a target relative phase angle, the ECU 51 calculates the current phase angle of the camshaft 6 and crankshaft from the current angle data detected by the cam angle sensor 53 and crank angle sensor 54 as shown in FIGS. 8 and 9 (Box 58).

Whether the phase angle of the camshaft relative to the crankshaft be advanced in D1 direction or retarded in D2 direction depends on the sign of the deviation calculated. In the example shown herein, it is assumed that the phase angle is retarded when the sign is positive but retarded otherwise.

When the deviation is positive, the ECU 51 sends a command signal to the driver circuit 52 to cut off the electricity to the second electromagnetic actuator 38, but otherwise sends a command signal to cut off the electricity of the first electromagnetic actuator 21 (Box 59). As a consequence, the control rotor associated with the de-energized actuator begins to rotate in the phase advancing direction D1 relative to the other control rotor 2.

When the phase advancing actuator 21 is de-energized, the camshaft 6 integral with the first control rotor 3 begins to rotate in the phase advancing direction D1 together with the first control rotor 3 integral therewith, thereby varying the phase angle of the camshaft relative to the crankshaft. When the second electromagnetic actuator 38 is de-energized, the second control rotor 32 is rotated in the phase advancing direction D1 relative to the first control rotor 3, thereby bringing the second link pin 35 and ring member 36 into operation. As a consequence, the camshaft 6 is rotated, together with the first control rotor 3 integral therewith, in the phase retarding direction D2 relative to the drive rotor 2, thereby retarding the camshaft relative to the crankshaft.

This deviation is repeatedly tested as to whether it is in the allowed threshold range or not (Box 59). If the deviation is not in the threshold range, no command signal is sent from the ECU 51 to the driver circuit 52 and the phase angle varying operation is continued without activating the first electromagnetic actuator 21 or second electromagnetic actuator 38. On the other hand, if the deviation is determined to be in the threshold range, a cut off signal is sent from the ECU 51 to the driver circuit 52 based on the registered data to re-activate the inactivated electromagnetic actuator and stop the mutual rotation of the first and second control rotors 3 and 32, thereby hold the two control rotors unrotatable. As a result, phase angle varying operation for the crankshaft and camshaft 6 is ended.

In FIG. 10, the electric current to the phase retarding actuator 38 is cut off once and then turned back to the registered (or initial) level. This causes the phase angle of the camshaft relative to the crankshaft to be varied from the current phase angle to a retarded target relative phase angle. This varied phase angle is maintained until the electric current to the phase advancing actuator 21 is cut off once and then turned back to the registered level in the next step. This causes the varied relative phase angle of the camshaft to be returned to the initial relative phase angle.

In FIG. 10, dotted curves indicate a conventional approach in which the first and second electromagnetic actuators 21 and 38, respectively, are energized to retard the relative phase angle once from a current phase angle (referred to as initial phase angle) and then recover the initial phase angle from the retarded phase angle. In the conventional approach, in order to maintain a relative phase angle as it is, both of the two electromagnetic actuators are simultaneously cut off, and only one electromagnetic actuator associated with the control rotor to be advanced or retarded is energized to attract that control rotor so as to vary the relative phase angle to a target phase.

Comparing the solid curves with dotted curves, it is seen that in the present invention a phase variation command is completed within a time from t1 to t2, in contrast to the conventional method which requires a longer time from t1 to t2' to complete such variation. Similarly, in the present invention the phase recovery procedure for recovering the initial phase angle from the target phase angle (which is (the retarded phase angle in this example) requires a shorter time from t3 to t4 than a conventional time from t4 to t4'.

Figure 11:
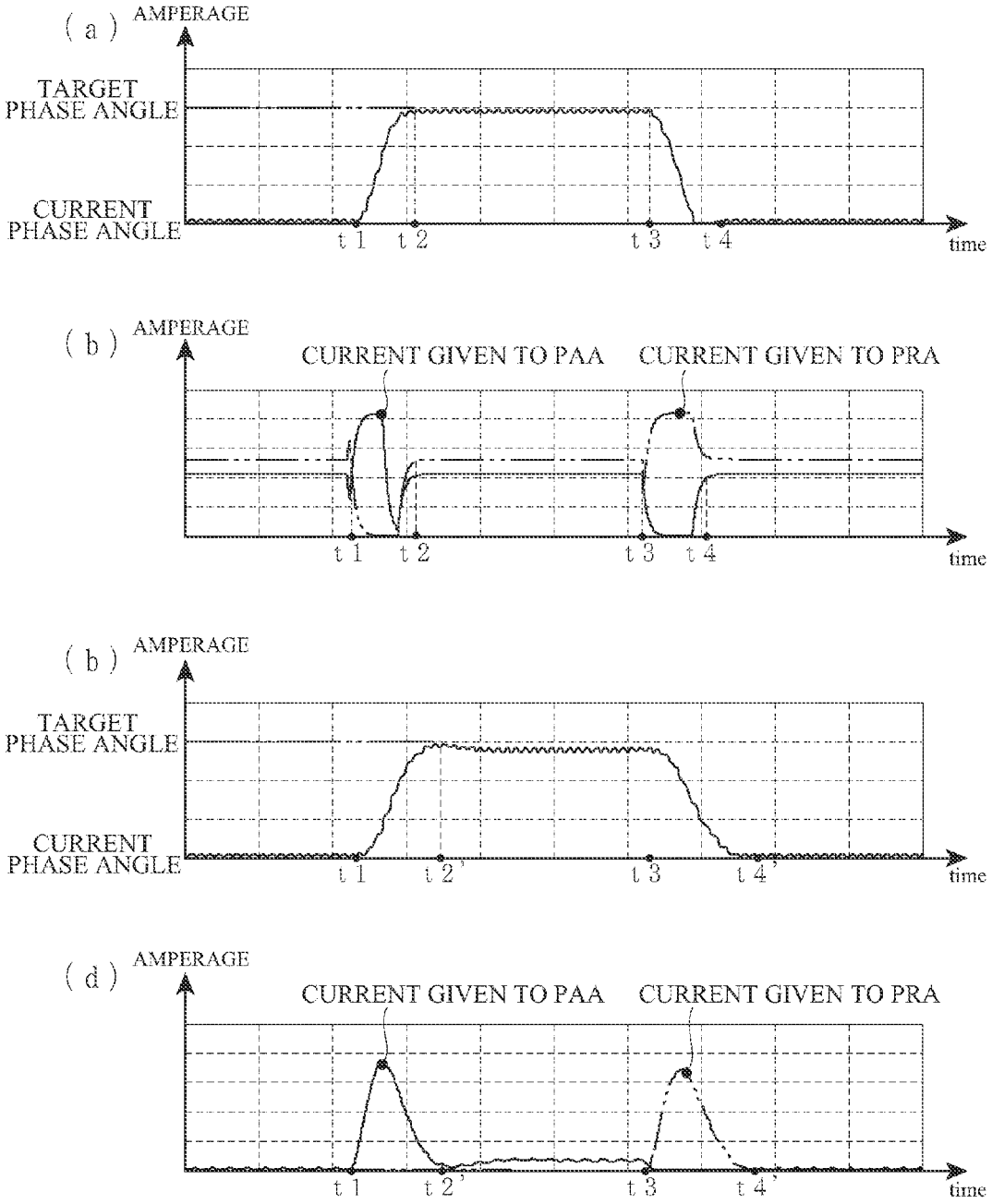
FIG. 11 are graphical representation of experimental phase angle variation as a function of time observed in an inventive and conventional variable cam phaser. More particularly, FIG. 11(*a*) shows phase angle variation in one embodiment of the present invention.

FIG. 11(*a*) shows the results of experiments in which the first and second electromagnetic actuators 21 and 38, respectively, are activated to vary the relative phase angle following the inventive control method shown in FIG. 11(*b*). FIG. 11(*c*) shows how the relative phase angle variation takes place when the first and second electromagnetic actuators 21 and 38, respectively, are energized in the conventional approach as shown in FIG. 11(*d*). It is seen that in this mode when one electromagnetic actuator associated with a phase angle variation is cut off, the amperage of the other electromagnetic actuator rises. It is observed in FIG. 11, as in FIG. 10, that the time required to vary the relative phase angle from an original (or initial) to a target relative phase angle requires a time from t1 to t2 in the present invention, which is shorter than the conventional time from t1 to t2'. Similarly, the time from t3 to t4 to recover the initial relative phase angle from the target relative phase angle in the present invention is shorter than the conventional time from t3 to t4'.

In short, time from t1 to t3 required to vary the relative phase angle from the current angle to a target angle is shorter by t2'-t2 in the inventive control method than in the conventional method, and time from t3 to t4 required to recover from the target phase angle to the initial phase angle is shorter by t4'-t4 in the inventive control method than in the conventional method. The reason for this is that in varying the relative phase angle to a target phase angle energization of an electromagnetic actuator to attract the control rotors is not needed in the invention since the inventive control rotors are preliminarily attracted by the electric actuators, and that in ending the relative phase variation the advanced control rotor is braked by the actuator, so that phase varying actions, and hence the response performance of the apparatus, are increased in the invention.

It is noted that in the present embodiment the electric current to the relevant phase angle varying electromagnetic actuator is completely cut off when varying the phase angle, but it is not necessary to do so since such phase angle varying operation will be started when the electric current is lowered to a certain level.

BRIEF DESCRIPTION OF NOTATIONS

1 variable cam phaser for an automobile engine
2 drive rotor
3 first control rotor
6 camshaft
10 relative phase angle varying mechanism
21 first electromagnetic actuator (for phase advancement)
32 second control rotor
38 second electromagnetic actuator (for phase retardation)
50 controller
52 driver circuit
53 cam angle sensor
54 crankshaft angle sensor
58 deviation calculation section
59 sign determination section
60 threshold determination section
61 operation commanding section
L0 camshaft axis

The invention claimed is:

1. A variable cam phaser for an automobile engine for varying open/close valve timing of the engine, comprising:

a drive rotor driven by a crankshaft of the engine;

a first and a second control rotor rotatable relative to each other, arranged coaxial with a camshaft of the variable cam phaser and driven by a crankshaft of the engine;

a first electromagnetic actuator adapted to provide the first control rotor with a braking torque;

a second electromagnetic actuator adapted to provide the second control rotor with a braking torque; and a mechanism for varying a phase angle of the camshaft relative to the crankshaft, thereby varying an open/close valve timing of the engine, wherein the first and the second electromagnetic actuators, when energized, operate simultaneously to render the first and the second rotating control rotors mutually unrotatable, and an electric current to one of the first and the second electromagnetic actuators is reduced to reduce the braking torque of said one electromagnetic actuator in operation, thereby causing one control rotor associated with said one actuator to be accelerated to rotate relative to the other control rotor.

2. The variable cam phaser according to claim 1, wherein said one electromagnetic actuator that has lowered its braking torque recovers its braking torque to stop the relative rotation of the first and the second control rotors.

* * * * *